US009227437B2

(12) United States Patent
Ando et al.

(10) Patent No.: US 9,227,437 B2
(45) Date of Patent: Jan. 5, 2016

(54) LABEL PRINTER AND LABEL PRINTING SYSTEM

(71) Applicant: Seiko Epson Corporation, Tokyo (JP)

(72) Inventors: Mitsuhisa Ando, Matsumoto (JP); Masahiko Yamada, Omi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/402,187

(22) PCT Filed: May 21, 2013

(86) PCT No.: PCT/JP2013/003235
§ 371 (c)(1),
(2) Date: Nov. 19, 2014

(87) PCT Pub. No.: WO2013/179607
PCT Pub. Date: Dec. 5, 2013

(65) Prior Publication Data

US 2015/0145916 A1 May 28, 2015

(30) Foreign Application Priority Data

May 30, 2012 (JP) ..... 2012-122800

(51) Int. Cl.

| | |
|---|---|
| ***B41J 29/38*** | (2006.01) |
| ***B41J 11/66*** | (2006.01) |
| ***B41J 3/407*** | (2006.01) |
| ***B41J 11/00*** | (2006.01) |

(52) U.S. Cl.
CPC ..... *B41J 11/663* (2013.01); *B41J 3/4075* (2013.01); *B41J 11/008* (2013.01)

(58) Field of Classification Search
USPC ..... 347/5, 9, 16; 428/40.1
See application file for complete search history.

(56) References Cited

U.S. PATENT DOCUMENTS

| | | | | |
|---|---|---|---|---|
| 6,390,584 | B1 * | 5/2002 | Larson et al. | 347/16 |
| 7,534,476 | B2 * | 5/2009 | Banks | G06K 19/041 283/81 |
| 2002/0033959 | A1 | 3/2002 | Ando et al. | |

FOREIGN PATENT DOCUMENTS

| | | | |
|---|---|---|---|
| JP | 09-211835 | A | 8/1997 |
| JP | 2002-192814 | A | 7/2002 |
| JP | 2002-292964 | A | 10/2002 |
| JP | 2003-200632 | A | 7/2003 |

* cited by examiner

*Primary Examiner* — Lam Nguyen

(57) ABSTRACT

A label printer can appropriately print an image and attribute information on a label.
A label printer 1 has a printhead 26, and a control unit 60 that prints an image and attribute information for the image on a label 52 by the inkjet head 26. The label 52 is separated by a half-cut 55 into a first label part 56 and a second label part 57, and removably affixed to a continuous liner 51. The control unit 60 of the label printer 1 includes an image printing control unit 61 that prints an image on the first label part 56, and an attribute information printing control unit 62 that prints image attribute information on the second label part 57.

4 Claims, 7 Drawing Sheets

X
Y

LABEL PRINTER AND LABEL PRINTING SYSTEM

TECHNICAL FIELD

The present invention relates to a label printer and a label printing system that prints images such as photographic images on labels.

BACKGROUND

Image forming devices that can automatically print a text string representing print attributes in a margin of the printout so that a large number of printed materials can be easily sorted and organized even after some time has passed from the time they were printed are known from the literature. An example of such a device is disclosed in PTL 1. FIG. 6 of PTL 1 shows a text string of print attributes printed in the margin at the trailing end or the leading end of the print data on roll paper.

CITATION LIST

Patent Literature

[PTL 1] JP-A-2002-192814

SUMMARY OF INVENTION

Technical Problem

To sort and organize printouts of photographs and other images printed by an inkjet printer or thermal printer, the printed images are typically attached to backing paper and then filed chronologically, for example. To do this more efficiently, label paper having adhesive labels removably affixed to a liner could be used as the print medium. This is convenient because the printed label can be removed from the liner and the label then applied where desired.

Even when printing on labels, printing attribute information about the printed content at the same time is also desirable. Attribute information about each printed image is particularly important when sorting and organizing printed images many days after numerous pictures taken with a camera, for example, are printed to label paper.

However, printing pictures and attributes on labels has not been addressed in the related art. Simply creating a margin and printing attributes in the margin instead of printing the image over the entire label may also not be desirable because of the need to reduce the size of the printed image. The attribute information is referenced when sorting and organizing the printed images, and printing the attributes with the image on the label is also not desirable when only the printed image is to be saved, for example.

Considering the foregoing, the present invention is directed to providing a label printer and a label printing system that can print an image on a label and related attribute information in an appropriate format.

Solution to Problem

To achieve the foregoing object, a label printer according to the invention is characterized by a conveyance unit configured to convey a recording medium having a liner and a label that is removably affixed to the liner and has a cut forming a first label part and a second label part;

a printhead configured to print on the label of the recording medium; and a control unit configured to control printing an image on the first label part and printing attribute information for the image on the second label part using the printhead.

A label printing system according to the invention is characterized by a print unit including a conveyance unit that conveys a recording medium having a liner and a label that is removably affixed to the liner and has a cut forming a first label part and a second label part, and a printhead that prints on the label of the recording medium conveyed by the conveyance unit; and a control unit configured to control printing an image on the first label part and printing attribute information for the image on the second label part using the printhead.

In the invention, labels on the recording medium are separated by a cut into a first label part and a second label part, an image is printed in the first label part and attribute information about the image is printed in the second label part. An image and attribute information are thus printed as a pair to a label, and the first label part with the printed image and the second label part with the printed attribute information can be individually removed from the liner of the recording medium.

Because the image and attribute information are printed as a pair to each label, the images can be organized and sorted based on the attribute information easily and efficiently after numerous photographs or other images are printed. The first label part alone can also be affixed to an album or such for storage when storing only the printed image, or both the printed image and attribute information can be removed from the liner and affixed to a specific location when keeping both. A wide range of storage methods can therefore be flexibly accommodated. In addition, because images are printed in chronological order to individual labels if continuous label paper is used as the recording medium, the invention is suited to keeping and organizing printed images in chronological order.

The cut is a half-cut cutting partially between the first label part and the second label part; and a half-cut surrounding the first label part with the second label part is made in the label. In this configuration, the control unit can print part of the image on the second label part and print the first label part without a border. This configuration enables easily printing an image on the first label part without a border.

DESCRIPTION OF EMBODIMENTS

A preferred embodiment of the invention is described below with reference to the accompanying figures.

Figures 1A, 1B, 1C, 1D:
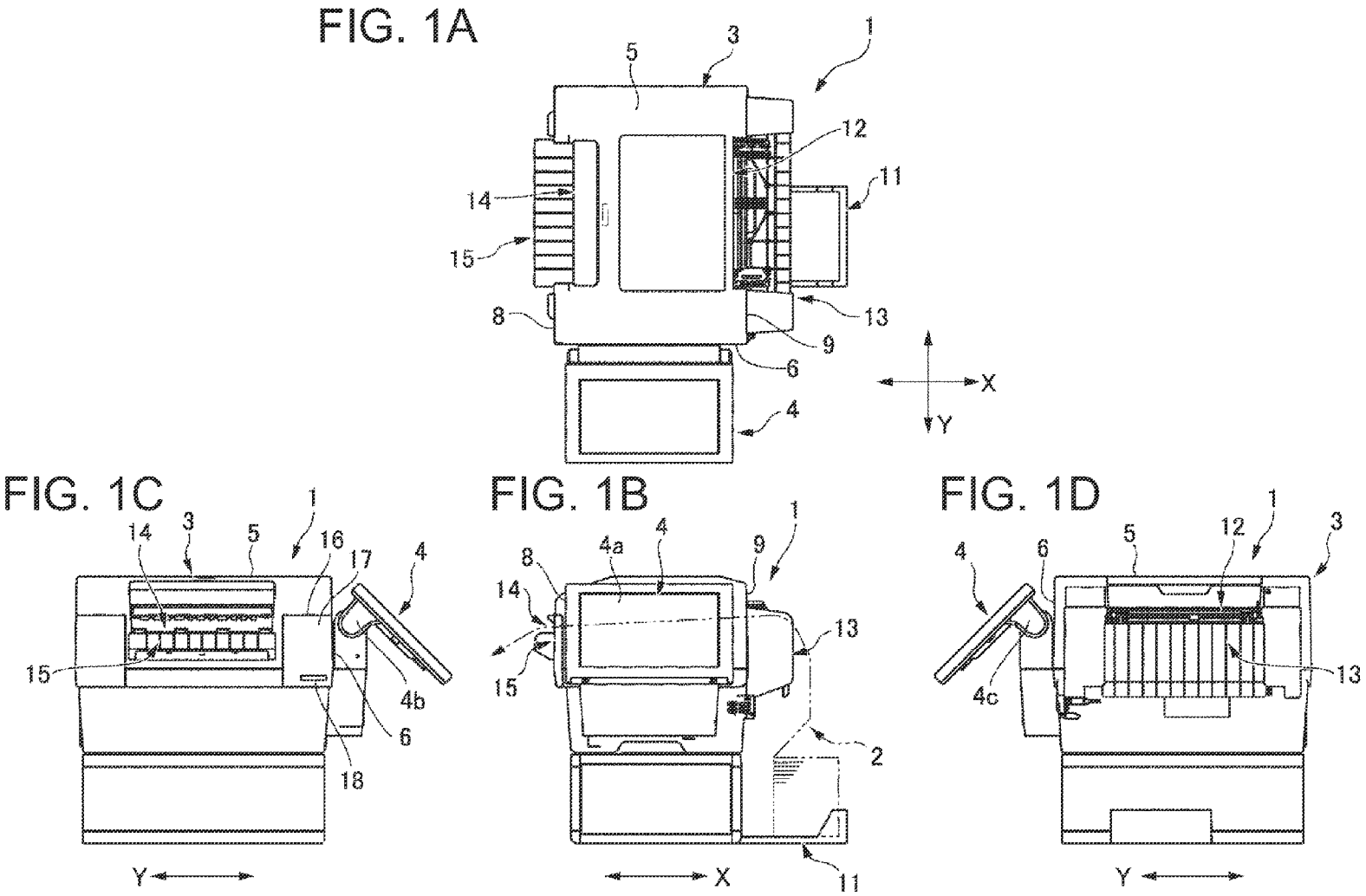
FIG. 1 shows four sides of a label printer applying the invention.
Figure 2:
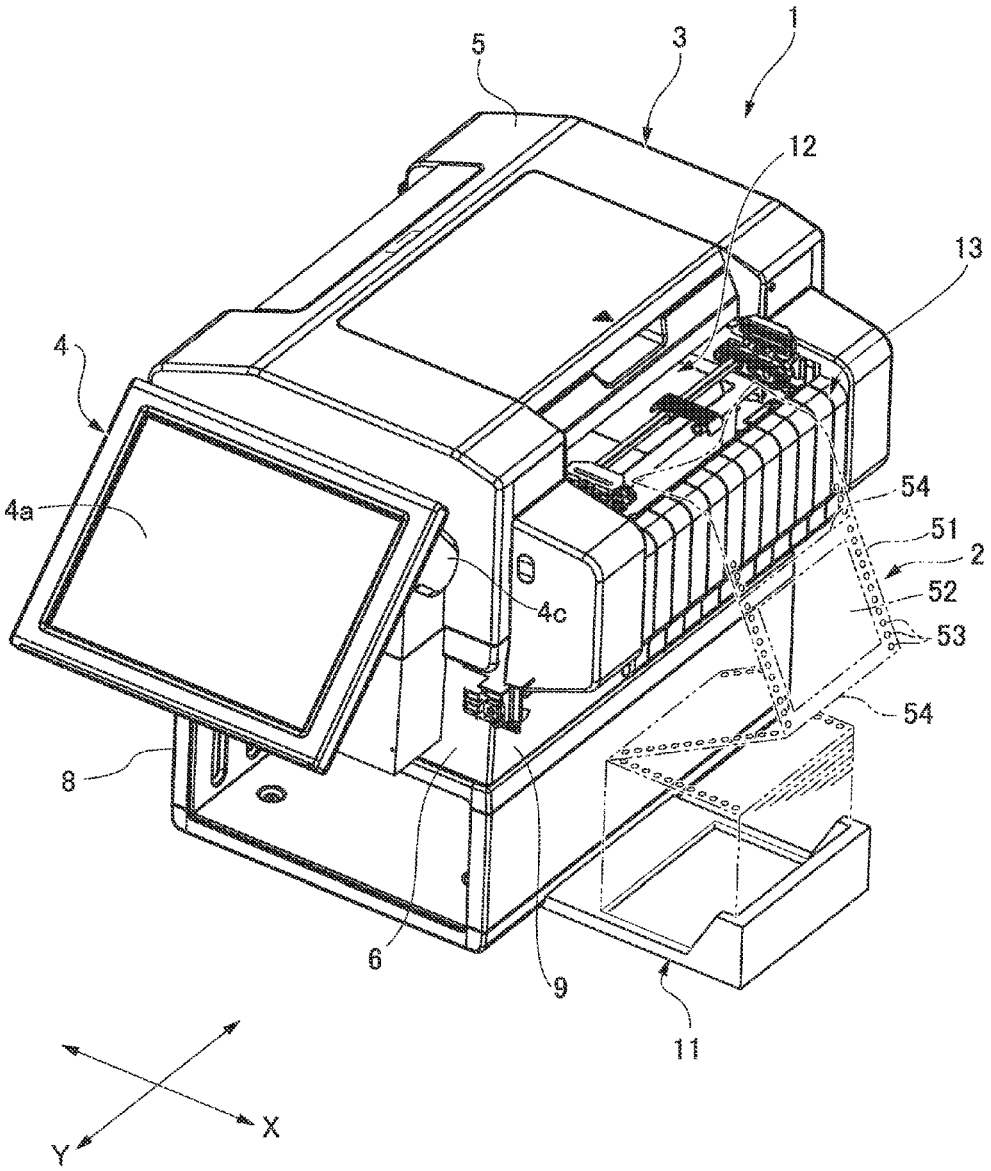
FIG. 2 is an oblique view of the label printer.

FIG. 1 (*a*) to (*d*) are a top view, front view, left side view, and right side view of a label printer according to this embodiment of the invention, and FIG. 2 is an external oblique view of the label printer as seen at an angle from the front right. The label printer 1 according to this embodiment prints a photographic image and image attribute information on individual labels 52 of continuous label paper 2 used as the conveyed medium, and the labels 52 are removably affixed to the liner 51 of the label paper 2.

The label printer 1 has a printer cabinet 3 and an LCD panel 4 for display and input operations. The display screen 4*a* of the LCD panel 4 functions as a touch panel, and inputting printer commands, selecting print information, and other input operations can be performed by operating the function buttons that are displayed.

The LCD panel 4 is attached to a position near the top of the front 6 of the printer cabinet 3 with the display screen 4*a* facing forward. In this example, left and right arms 4*b*, 4*c* protrude to the back from the opposite sides of the top back part of the LCD panel 4, and the ends of these arms 4*b*, 4*c* are supported on the printer cabinet 3 pivotably on an axis of rotation extending on the widthwise axis X of the printer. The LCD panel 4 can, for example, pivot from a vertical position with the display screen 4*a* facing the front, to a horizontal position with the display screen 4*a* facing up.

A paper tray 11 extends horizontally to the back from the bottom part of the right side 9 of the printer cabinet 3. As shown by the imaginary lines in FIG. 1 (*b*) and FIG. 2, the label paper 2 is loaded in a stack folded at a constant interval in the paper tray 11. A paper entrance 12 is formed near the top of the right side 9, and a tractor unit 13 protruding to the right from the paper entrance 12 is attached to the printer cabinet 3. The label paper 2 loaded in the paper tray 11 is fed by the tractor unit 13 from the right side of the printer into the paper entrance 12.

A paper exit 14 is formed in the opposite left side 8 of the printer cabinet 3 at substantially the same height as the paper entrance 12. An exit tray 15 is attached to the printer cabinet 3 extending horizontally to the left of the printer from the paper exit 14. The printed label paper 2 is discharged from the paper exit 14, and discharged by the exit tray 15 horizontally to the left from the printer.

An ink cartridge loading opening 16 for installing an ink cartridge (not shown in the figure) in an ink cartridge loading unit (not shown in the figure) formed inside the printer cabinet 3 is formed in the left side 8 of the printer cabinet 3 on the side of the exit tray 15 toward the front of the printer, and this ink cartridge loading opening 16 is covered by an access door 17. A card slot 18 for a storage medium, such as a memory card, that stores printing information is formed at a position near the bottom of the access door 17.

Figure 3:
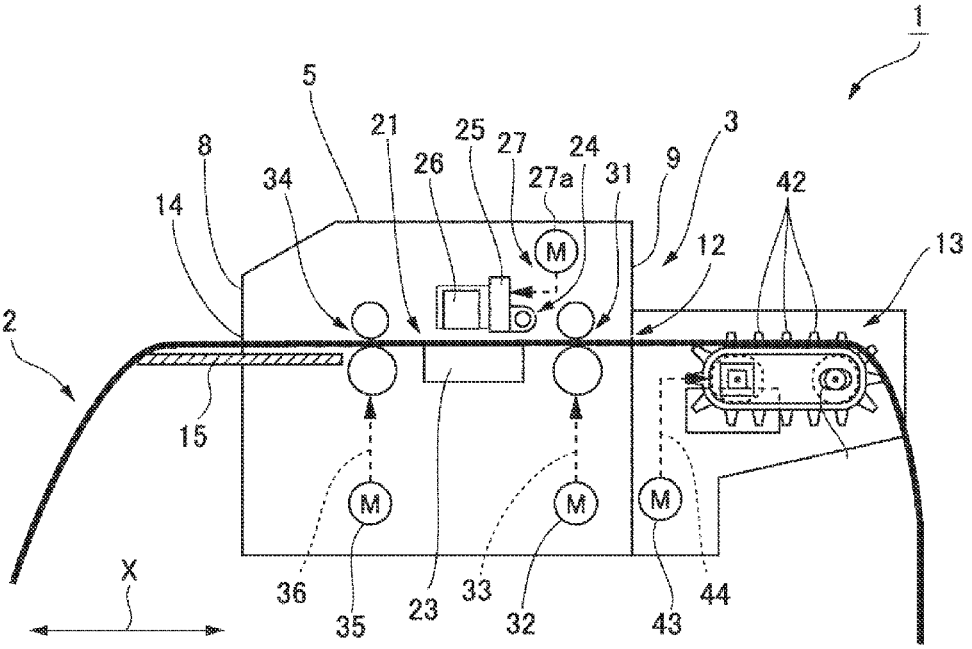
FIG. 3 schematically shows the paper conveyance path part of the label printer.

FIG. 3 schematically illustrates the paper conveyance path inside the printer cabinet 3 of the label printer 1. As indicated by the bold line in FIG. 3, the paper conveyance path 21 is formed along the widthwise axis X of the printer. The paper conveyance path 21 extends from the paper entrance 12 formed in the right side 9 to the paper exit 14 formed in the left side 8.

A platen 23 is disposed near the middle of the paper conveyance path 21. The platen 23 extends perpendicularly to the paper conveyance direction, that is, parallel to the front-back axis Y of the printer. A carriage guide rail 24 extending parallel to the front-back axis Y is disposed above the platen 23. The carriage guide rail 24 is supported by the sheet metal mechanical frame (not shown in the figure) of the printer cabinet 3. Ahead carriage 25 is slidably attached to the carriage guide rail 24, and an inkjet head 26 is mounted on the head carriage 25 with the nozzle face facing down opposite the platen 23 that defines the print position. The head carriage 25 can move bidirectionally on the front-back axis Y along the carriage guide rail 24 by means of a carriage drive mechanism 27 comprising a motor 27*a* and belt and pulley mechanism (not shown in the figure) known from the literature.

A paper feed roller pair 31 for feeding the label paper 2 toward the print position is disposed between the tractor unit 13 and the platen 23 disposed at the print position of the inkjet head 26. As indicated by the dotted line in FIG. 3, drive power from a paper feed motor 32 is transferred through a drive power transfer mechanism 33 including a gear train to the paper feed roller pair 31. A discharge roller pair 34 for discharging the label paper 2 after printing is disposed to a position on the left side of the printer (a position on the downstream side in the paper conveyance direction) from the print position. As indicated by the dotted line in FIG. 3, drive power from a discharge motor 35 is transferred through a drive power transfer mechanism 36 including a gear train to the discharge roller pair 34.

Next, the tractor unit 13 feeds the label paper 2 toward the print position by sequentially engaging and moving tractor pins 42 that circulate along an oval drive path in sprocket holes 53 (see FIG. 2, FIG. 4) formed in both widthwise edges of the label paper 2. Drive power from a tractor drive motor 43 is transferred through a drive power transfer mechanism 44 including a gear train to the tractor unit 13.

Figure 4:
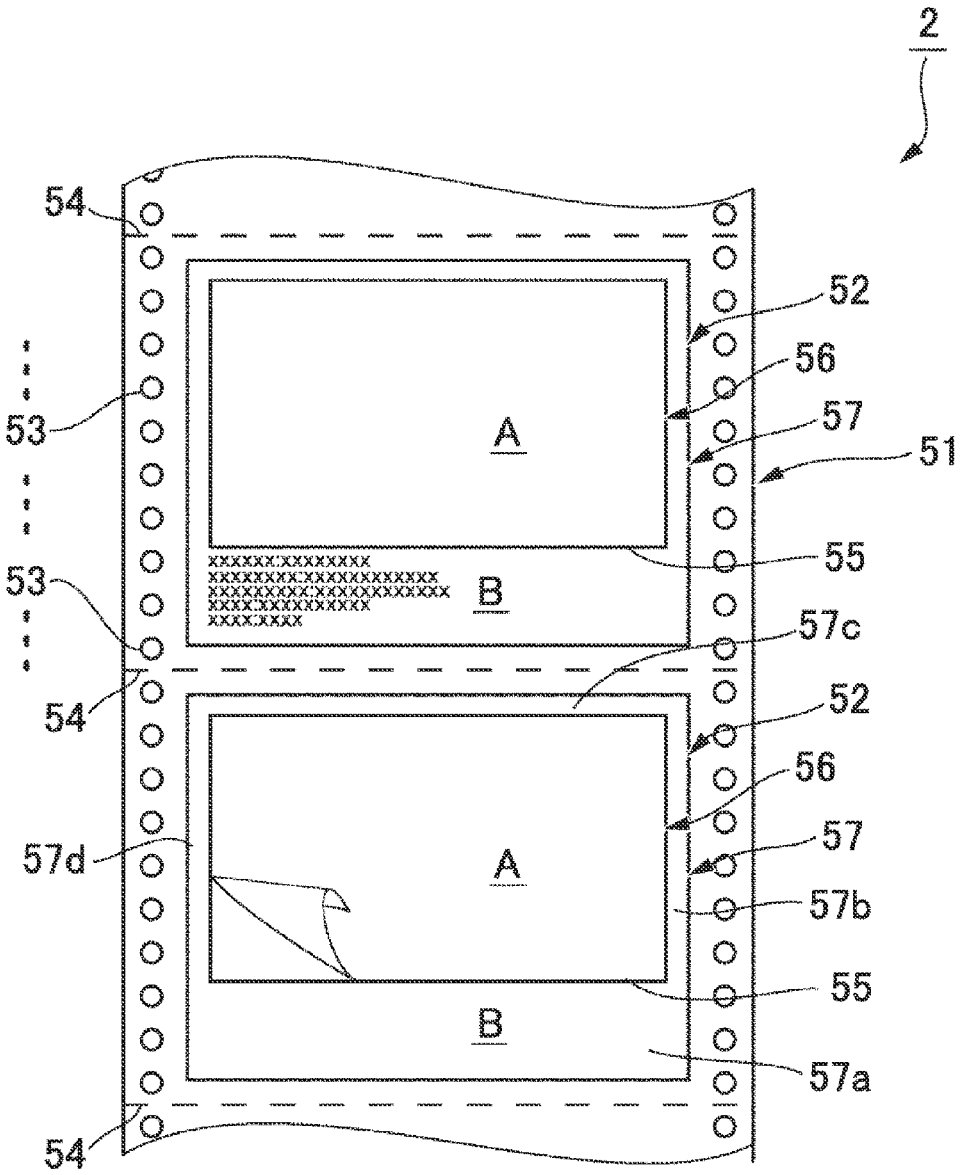
FIG. 4 is a plan view of label paper.

FIG. 4 is a plan view illustrating the label paper 2. Referring to FIG. 2 and FIG. 4, the label paper 2 has a continuous liner 51 of a constant width, and rectangular labels 52 removably affixed to the surface of the liner 51 at a specific interval lengthwise. An adhesive layer (not shown in the figure) is applied to the back of each label 52, and a label 52 removed from the liner 51 can be affixed to a desired location.

Sprocket holes 53 are formed at a constant interval lengthwise along both edges of the paper width. A perforation 54 is formed across the paper width between each label 52, and by folding the paper back and forth at the perforations 54, the label paper 2 is loaded in a stack in the paper tray 11 of the label printer 1.

A cut is formed separating each label 52 of the label paper 2 into a first label part 56 and a second label part 57. In this example, a rectangular half-cut 55 is made as the cut in the label 52. Each label 52 thus remains of fixed to the liner 51 separated into a rectangular first label part 56 surrounded by the half-cut 55, and a rectangular window frame-shaped second label part 57 surrounding the half-cut 55. A perforation or other separating line could be formed in the label 52 instead of a half-cut. The frame-shaped second label part 57 includes a wide frame part 57*a* on the trailing side in the top-bottom direction of the label paper 2, and the other three frame parts 57*b*, 57*c*, 57*d* are narrow frame parts.

As described below, the surface of the first label part 56 is the image printing area A where a photographic image, for example, is printed, and the wide frame part 57*a* of the second label part 57 is an image attribute information printing area B where image attribute information for the printed image is printed. For example, when the printed image is a photograph, the image attribute information could include the date printed by the label printer 1, the date the picture was taken, the photographic equipment, the file name of the photograph, or where the photograph is stored.

Figure 5:
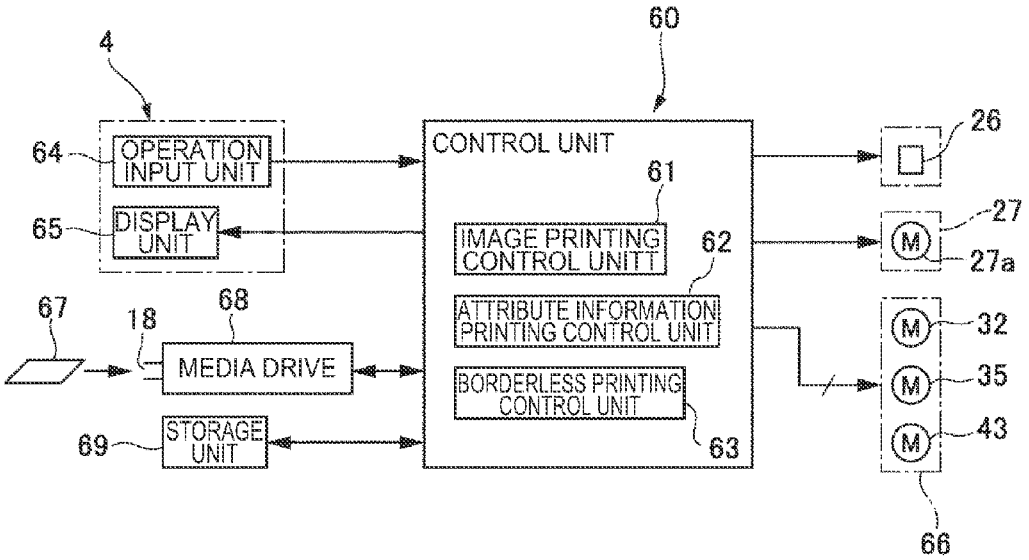
FIG. 5 is a basic block diagram illustrating the control system of the label printer.

FIG. 5 is a basic block diagram showing the control system of the label printer 1. The label printer 1 according to this embodiment is not limited to being controlled by a personal computer or other host device, can be used as a stand-alone printer, and has a control system built around a control unit 60 including a computer system. The control unit 60 controls operation of the label printer 1 based on firmware installed in internal memory (not shown in the figure).

The control unit 60 also runs a previously installed label printing application program and executes a process that generates print data for printing photographs or other image data on the first label part 56 and printing image attribute information in the second label part 57 of a label 52. The control unit 60 also executes a process to generate print data for printing an image on a label 52 in a print area slightly larger than the first label part 56 (a print area including the surface of the first label part 56 and the inside circumference edge parts of the second label part 57 surrounding the first label part 56) in order to print an image in the first label part 56 in a borderless print mode with no white space around the four sides.

By running installed firmware and application programs, the control unit 60 therefore functions as an image printing control unit 61 that prints an image in the first label part 56, an attribute information printing control unit 62 that prints attribute information in the second label part 57, and a borderless printing control unit 63.

An operation input unit 64 and a display unit 65 are connected to the control unit 60. The operation input unit 64 is a touch panel, and is embodied by the LCD panel 4. Various operating screens, such as a setup screen for a borderless image print mode, are displayed on the display unit 65, which is also embodied by the LCD panel 4.

The inkjet head 26, carriage drive mechanism 27 (including motor 27*a*), and the conveyance unit 66 (including motors 32, 35, and 43) of the label paper 2 are also connected to the control unit 60. The control unit 60 generates print data for label printing based on the input operations, for example, and controls driving these other parts (26, 27, 66), conveying the label paper 2, and printing on the label paper 2 based thereon.

A media drive 68 for reading information stored on a memory card 67 inserted from the card slot 18, and a storage unit 69 for saving information including photographic images that are read, are also connected to the control unit 60. For example, image data to be printed on the label paper 2 is read by the control unit 60 from a portable (removable) memory card 67 inserted by the user.

Figure 6:
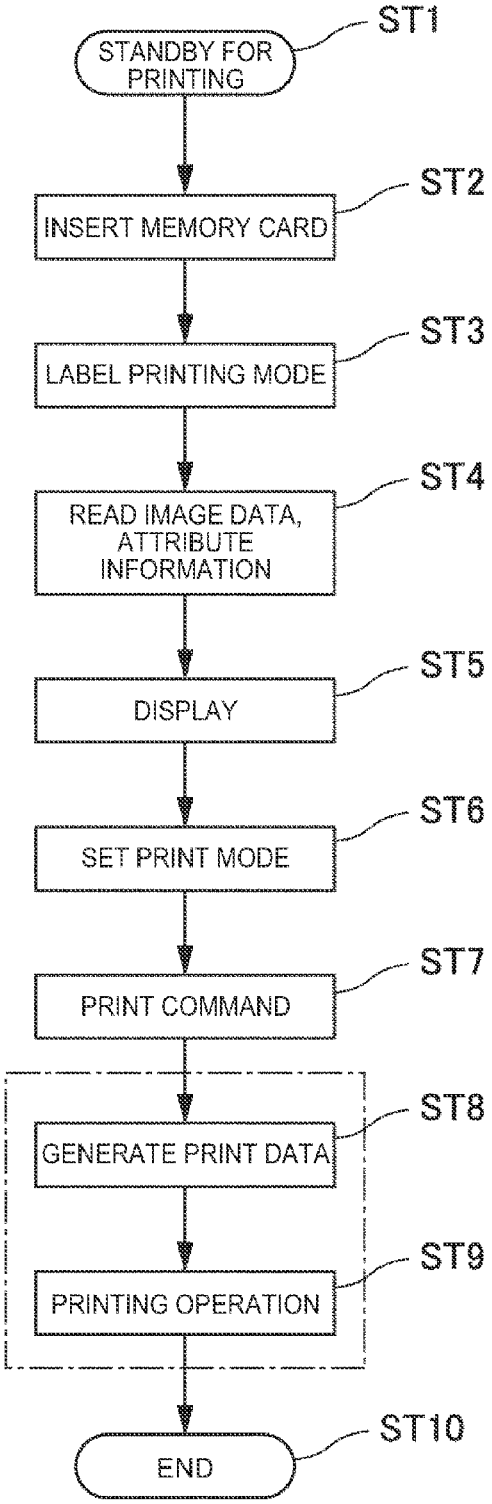
FIG. 6 is a basic flow chart of the label printing operation of the label printer.

FIG. 6 is a basic flow chart showing an example of the label printing operation of the label printer 1. Before label printing, the label paper 2 is set in the tractor unit 13, the power is turned on, and the label printer 1 enters a print standby mode (step ST1). The user then inserts a memory card 67 storing multiple photographic images and image attribute information to print in the card slot 18.

When the control unit 60 detects a memory card 67 was inserted (step ST2), the control unit 60 starts the label printing application, and changes the control mode to the label printing mode (step ST3). The control unit 60 then reads the series of image data and image attribute information for printing from the inserted memory card 67 (step ST4), displays a list of image information on the display unit 65, and prompts the user for a print command (step ST5).

A selection screen for a borderless image printing mode is also displayed on the display screen 4*a*, and if the user selects this mode, the control unit 60 changes the normal label printing mode to the borderless print mode (step ST6). If through the operation input unit 64 the user selects printing all of the image information that was read, for example, a corresponding image print command is input to the control unit 60.

When a print command is received (step ST7), the control unit 60 generates print data for printing in the image printing area A of the first label part 56 and the image attribute information printing area B of the second label part 57 of the label 52 based on each image and corresponding image attribute information that is read (step ST8). Based on the generated print data, the control unit 60 controls conveying the label paper 2, moving the inkjet head 26 with the carriage drive mechanism 27, and the ink droplet ejection operation of the inkjet head 26 to print a photographic image in the image printing area A of the surface of the first label part 56 and the image attribute information in the image attribute information printing area B in the second label part 57 of the label 52 conveyed to the print position (step ST9). When generating print data and printing on a label 52 is completed for all images that were read, the printing operation stops (step ST10).

If an operation instructing storing and saving the read image information is input on the display screen after printing ends, the control unit stores the read image information and image attribute information linked to each photographic image in storage unit 69, which is nonvolatile memory. This enables reprinting the pictures at a later date.

The photographic images printed on label paper 2 as described above are printed on individual labels 52 paired with the image attribute information. Unlike when only the photographic images are printed on labels 52, the photographic images can be easily sorted and organized based on the image attribute information for the photographic images. If the first label part 56 of each label 52 is the size of an L-size photograph, for example, the first label part 56 of the label 52 can be removed from the liner 51 and affixed and organized in a picture album.

In addition, if identification information for the memory card storing an image (such as the ID of the memory card assigned in the factory) is included in the image attribute information, finding a photographic image is extremely easy. In addition, if photographic images are printed to the labels 52 affixed to the label paper 2, which is continuous paper, the photographic images are printed in chronological order, and organizing them later is simple.

Figure 7A:
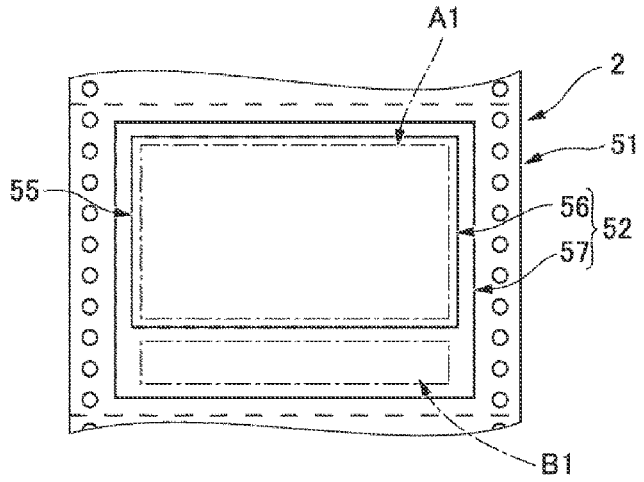
FIG. 7 illustrates the image printing area and the image attribute information printing area on a label.
Figure 7B:
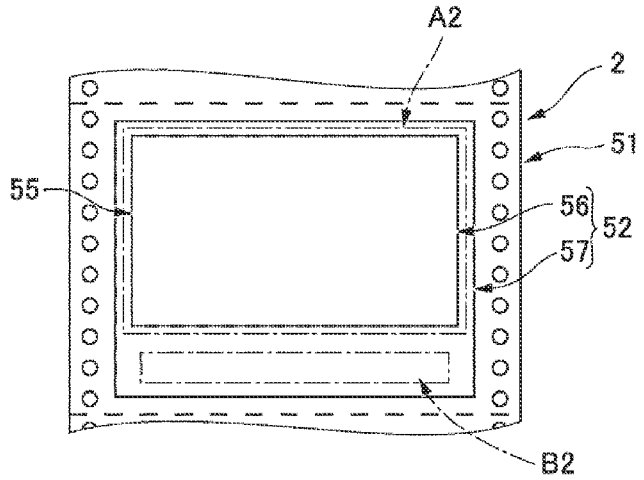
Figure 7C:
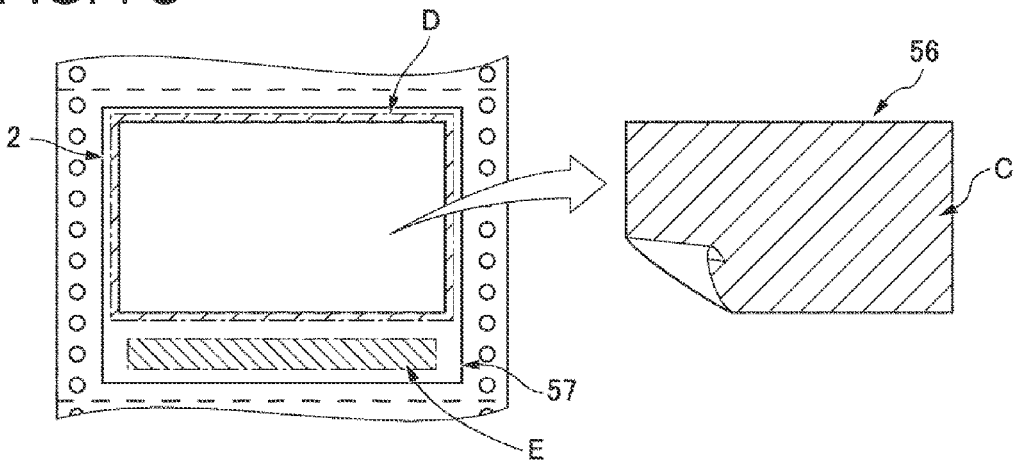

When the normal label printing mode is set, an image printing area A1 that is slightly smaller than the surface of the first label part 56 is specified as the image printing area A, and there is a border of a specific width around the four sides of the first label part 56 as indicated by the dot-dash line in FIG. 7 (*a*). An image attribute information printing area B1 of a size that fits within the surface area of the wide frame part 57*a* of the second label part 57 is also specified as the image attribute information printing area B.

However, when the borderless print mode is set, an image printing area A2 that is slightly larger than the first label part 56 is specified for the print data of the photographic images as indicated by the dot-dash line in FIG. 7 (*b*). More specifically, an image printing area A2of a size that does not exceed the three narrow frame parts 57*b*-57*d* of the second label part 57 is specified. The photographic images are then printed at a size corresponding to this image printing area A2. In this event, a narrow image attribute information printing area B2 set in the margin not interfering with the image printing area A2 is specified in the frame part 57*a* of the second label part 57 as the image attribute information printing area B.

When the first label part 56 of a label 52 printed in the borderless print mode is removed from the liner 51 as shown in FIG. 7 (*c*), a photograph C printed without a border on the surface of the first label part 56 is obtained. The portion of the printed image D outside the outside edges of the first label part 56 is left on the second label part 57 where the image attribute information E is printed. A photograph C printed without a border can thus be easily obtained.

OTHER EXAMPLES

The label printer 1 described above can be used in a so-called stand-alone mode, but the invention can also be applied as a label printing system including a host control unit such as a host computer and a print unit configured to receive print commands and print data therefrom and execute the label printing operation. The print unit in this configuration can use the same configuration as the label printer 1 described above. The invention can also be applied in the same way to a label printer having a thermal printhead or other type of printhead instead of an inkjet head.

Next, the label paper 2 in this example is separated into a rectangular first label part 56 and a frame-like second label part 57 by applying a half-cut 55 to each label 52. Separation of the first label part for image printing and the second label part 57 for printing image attribute information is not limited to this example.

For example, a rectangular label can be separated widthwise by a half-cut extending in a straight line along the length of the label paper, the width portion used as the first label part for image printing, and the remaining part used as the second label part for printing image attribute information. Further alternatively, a rectangular label can be separated widthwise by a half-cut extending in a straight line across the width of the label paper, forming a first label part for image printing, and a second label part for printing image attribute information. The shape of the label could obviously be a shape other than rectangular. The half cut could also be a curved or broken line.

Further alternatively, instead of labels being removably affixed at a specific interval to a continuous liner as described above, portions that become a single label formed at a specific interval to a continuous label removably affixed to a continuous liner can be used as the label paper. In this configuration, portions that become the labels are formed at a specific interval by half-cuts in the continuous label, and each label portion between half-cuts is separated into a first label part and a second label part by a half-cut.

Yet further, paper without sprocket holes can be used as the label paper, and in this configuration the tractor unit can be omitted.

INDUSTRIAL APPLICABILITY

As described above, the present invention is useful in a label printer and a label printing system that prints images such as photographs on labels, and can be applied in a label printing system having a label printer and a connected control device that controls the label printer.

The invention claimed is:

1. A label printer comprising:

a conveyance unit configured to convey a recording medium having a liner and a label that is removably affixed to the liner and has a cut forming a first label part and a second label part;

a printhead configured to print on the label of the recording medium; and a control unit configured to control printing an image on the first label part and printing attribute information for the image on the second label part using the printhead;

wherein the cut partially separates the first label part from second label part, and the cut surrounds the first label part is surrounded by the second label part.

2. The label printer described in claim 1, wherein the control unit controls printing part of the image on the second label part and printing the first label part without a border.

3. A label printing system comprising:

a print unit including a conveyance unit configured to convey a recording medium having a liner and a label that is removably affixed to the liner and has a cut forming a first label part and a second label part, and a printhead configured to print on the label of the recording medium conveyed by the conveyance unit; and a control unit configured to control printing an image on the first label part and printing attribute information for the image on the second label part using the printhead;

wherein the cut partially separates the first label part from the second label part, and the cut surrounds the first label part and is surrounded by the second label part.

4. The label printing system described in claim 3, wherein the control unit prints part of the image on the second label part and prints the first label part without a border.

* * * * *